US006241571B1

(12) United States Patent
Chow

(10) Patent No.: US 6,241,571 B1
(45) Date of Patent: Jun. 5, 2001

(54) BALLOON POWERED BUBBLE BLOWING DEVICE

(76) Inventor: Ki-Toe Chow, Unit G, 22/F, Nanyang Plaza 57 Hung To Road, Kwun Tong, Kowloon, Hong Kong (CN)

( * ) Notice: Subject to any disclaimer, the term of this patent is extended or adjusted under 35 U.S.C. 154(b) by 0 days.

(21) Appl. No.: 09/611,050

(22) Filed: Jul. 6, 2000

(51) Int. Cl.[7] ..... A63H 33/28
(52) U.S. Cl. ..... 446/18; 446/16
(58) Field of Search ..... 446/15, 16, 18, 446/20, 21; 40/408

(56) References Cited

U.S. PATENT DOCUMENTS

| | | | | |
|---|---|---|---|---|
| 2,560,582 | * | 6/1946 | Limber | 446/18 |
| 3,246,419 | | 4/1966 | Pawelka . | |
| 3,736,694 | * | 6/1973 | Lebensfeld | 446/16 |
| 3,834,066 | * | 9/1974 | Vargas | 446/21 |
| 4,299,049 | * | 11/1981 | Pimentel et al. | 446/15 |
| 4,775,348 | * | 10/1988 | Collins | 446/16 |
| 5,360,362 | * | 11/1994 | Cernansky et al. | 446/16 |

FOREIGN PATENT DOCUMENTS

| | | | | |
|---|---|---|---|---|
| 5285278 | * | 11/1993 | (JP) | 446/15 |
| 6182060 | * | 7/1994 | (JP) | 446/15 |

* cited by examiner

*Primary Examiner*—Jacob K. Ackun, Jr.
*Assistant Examiner*—Faye Francis
(74) *Attorney, Agent, or Firm*—LaMorte & Associates

(57) ABSTRACT

A bubble blowing assembly used to blow bubbles made of soap film. The bubble blowing assembly includes a housing. In the housing is formed an air flow chamber having a first end and a second end. A one-way valve is disposed at the first end of the air flow chamber. The one-way valve connects to a balloon or another inflatable air vessel. An arm is pivotally connected to the housing and is selectively positionable between a first position and a second position. The arm defines an aperture. When the arm is in the first position, the aperture on the arm is positioned in said reservoir. When the arm is positioned in the second position, the aperture on the arm is positioned next to the second end of the air flow chamber. An activation mechanism is provided within the housing. The activation mechanism engages both the one-way valve and the arm. When the activation mechanism is in an operating position, the activation mechanism moves both the one-way valve to its open condition and the arm to its second position. When the activation mechanism is in a non-operating position, the activation mechanism moves both the one-way valve to its closed condition and the arm to its first position.

14 Claims, 2 Drawing Sheets

BALLOON POWERED BUBBLE BLOWING DEVICE

BACKGROUND OF THE INVENTION

1. Field of the Invention

In general, the present invention relates to amusement devices that are used to blow bubbles. More particularly, the present invention relates to bubble blowing devices that contain internal sources of air so that bubbles can be created without manual blowing.

2. Description of the Prior Art

Bubble blowing devices have been popular with children for many generations. In that time, bubble blowing devices have been created in countless designs and styles. As such, the prior art is replete with many different types of bubble blowing devices.

Bubble blowing devices typically have the same functioning elements. A reservoir is provided for holding soapy water. An annular structure is provided to dip into the soapy water. Once dipped in the soapy water, a soap film extends across the annular structure. A stream of air is then blown through the annual structure, thereby creating bubbles from the soap film.

Typically, a child provides a stream of air by physically blowing air through the annular structure. Such a technique is simple. However, young children often have difficulty directing a stream of air with their mouths. As such, manual bubble blowing becomes difficult, if not impossible for certain children. Furthermore, manually blowing bubbles causes children to bring the annular structure close to their faces. As the bubbles are manually blown, many of the bubbles prematurely pop. This often causes the soap film to splash into the eyes of the child. With some children, the soapy film irritates the eye and causes discomfort.

To eliminate the above mentioned problems, bubble blowing devices have been invented that have the ability to generate their own stream of air. Some of these prior art devices use battery operated fans to create the stream of air. Other prior art devices use a hand pump to generate the needed stream of air. Such devices, however, are expensive because of the numerous parts needed in the manufacture of such devices.

A need therefore exists for a bubble blowing device that provides its own stream of air, yet is very low in cost and simple to manufacture. This need is met by the present invention as described and claimed below.

SUMMARY OF THE INVENTION

The present invention is a bubble blowing assembly used to blow bubbles made of soap film. The bubble blowing assembly includes a housing. In the housing is formed an air flow chamber having a first end and a second end. A one-way valve is disposed at the first end of the air flow chamber. The one-way valve connects to a balloon or another inflatable air vessel. An arm is pivotally connected to the housing and is selectively positionable between a first position and a second position. The arm defines an aperture. When the arm is in the first position, the aperture on the arm is positioned in a soap film reservoir. When the arm is positioned in the second position, the aperture on the arm is positioned next to the second end of the air flow chamber.

An activation mechanism is provided within the housing. The activation mechanism engages both the one-way valve and the arm. When the activation mechanism is in an operating position, the activation mechanism moves both the one-way valve to its open condition and the arm to its second position. When the activation mechanism is in a non-operating position, the activation mechanism moves both the one-way valve to its closed condition and the arm to its first position. The result is a simple hand held device that uses the air stream from a balloon to selectively blow bubbles.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The present invention device uses air from a balloon to blow bubbles. The shape of the present invention device is not of importance and it should be understood that the housing of the device can be shaped in any manner, provided the housing supports the functioning elements that are described below in the exemplary embodiment.

Figure 1:
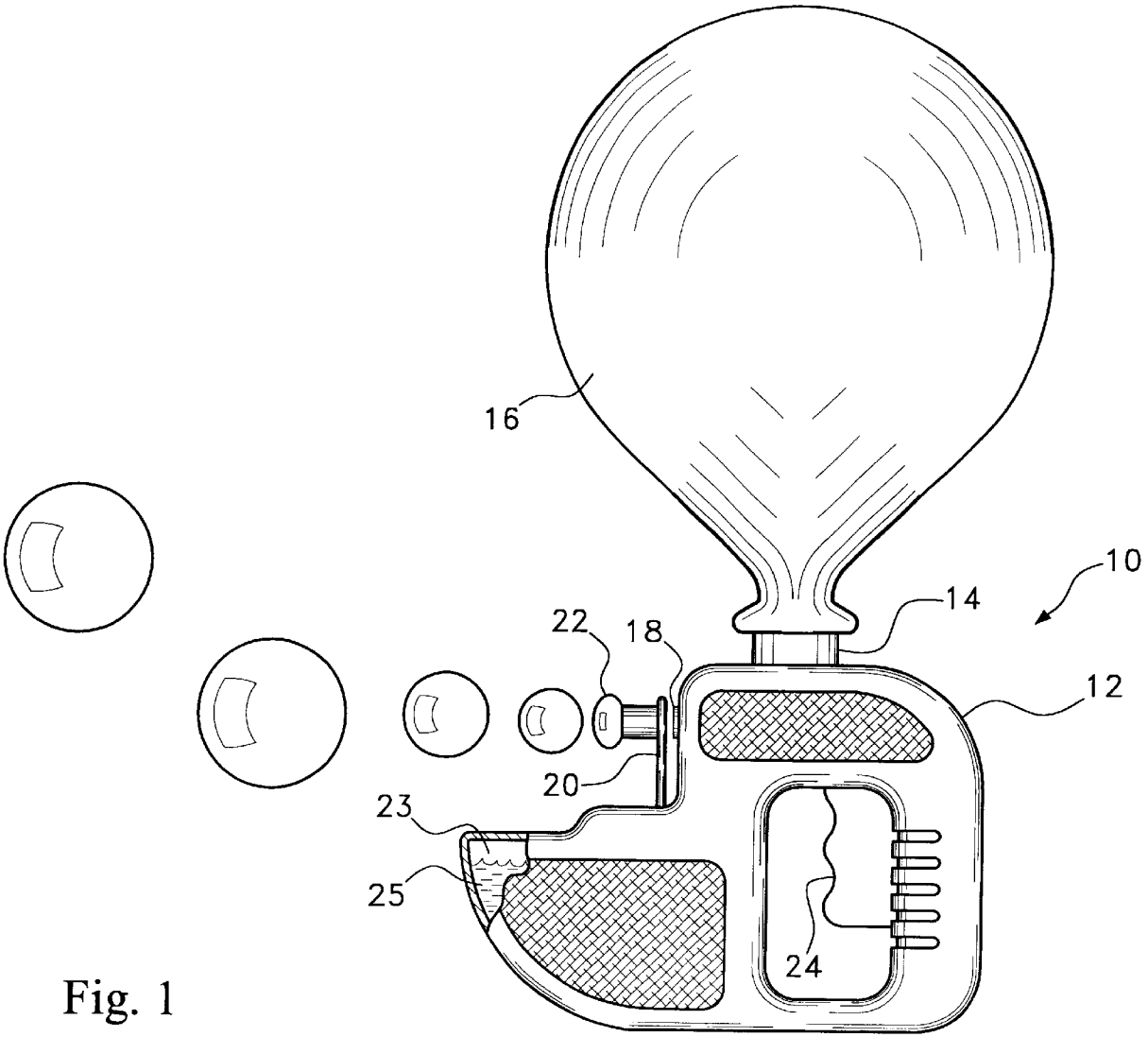
FIG. 1 is a side view of an exemplary embodiment of a bubble blowing device in accordance with the present invention.

Referring to FIG. 1, an exemplary embodiment of a bubble blowing device 10 is shown in accordance with the present invention. The bubble blowing device 10 contains a housing 12. At the top of the housing 12 is positioned a cylindrical supply stem 14. A latex balloon 16 is attached to the cylindrical supply stem 14 in a manner that will be explained later. The balloon 16 supplies the bubble blowing device 10 with a source of pressurized air. Within the housing 12, the pressurized air is selectively directed to an output air port 18 that projects forward from the housing 12.

Within the housing 12 of the bubble blowing device 10 is a reservoir 23 that is filled with soapy water 25. A dipping arm 20 is pivotably connected to the housing 12 adjacent to the reservoir 23. The dipping arm 20 defines a bubble aperture through which bubbles 22 are formed. The dipping arm 20 pivotably rotates between two positions. In a first position, the bubble aperture is immersed in the reservoir 23. In the second position, the aperture of the dipping arm 20 is rotated in front of the output air port 18.

A trigger handle 24 extends from the housing 12. The trigger handle 24 serves two functions when squeezed. First, when the trigger handle 24 is squeezed, the trigger handle 24 enables air from the latex balloon 16 to flow through the housing 12 to the output air port 18. This causes a stream of air to project from the output air port 18. Second, when the trigger handle 24 is squeezed, the trigger handle 24 moves the dipping arm 20 from the first position in the reservoir 23 to the second position in front of the output air port 18. Since a stream of air is projected out of the output air port 18, bubbles 22 are formed through the aperture in the dipping arm 20.

Figure 2:
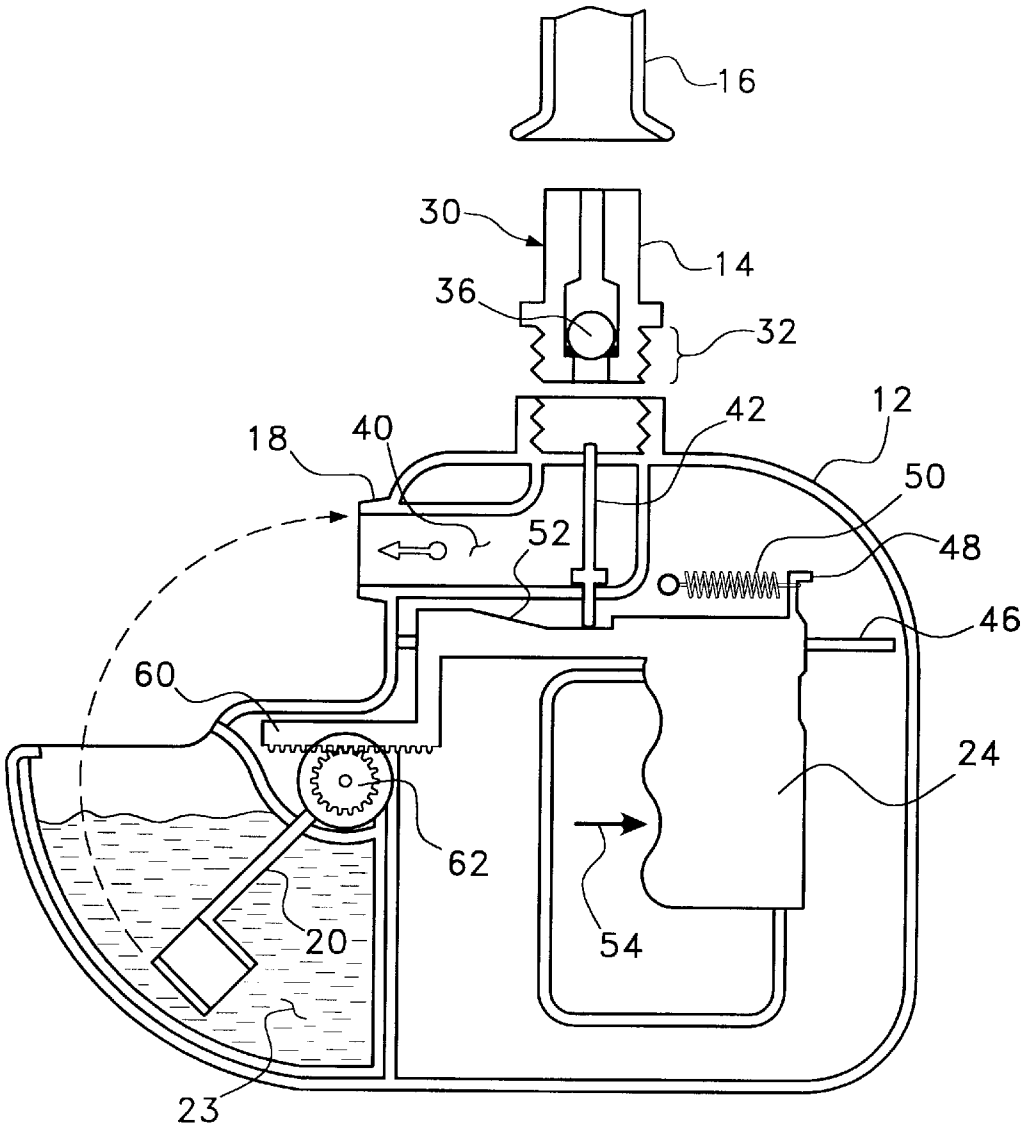
FIG. 2 is a cross-sectional view of the embodiment of the present invention shown in FIG. 1.

Referring to FIG. 2, it can be seen that the cylindrical supply stem 14 is part of a one-way valve assembly 30. The one-way valve assembly 30 has a threaded neck 32 that threads into the housing 12. Within the one-way valve 30 is a valve ball 36. The air pressure within the balloon 16 biases the valve ball 36 into a closed position that prevents air from entering or exiting the bottom of the one-way valve 30.

The latex balloon 16 attaches to the cylindrical supply stem 14 of the one-way valve 30. The balloon 16 is attached to the one-way valve 30 in a deflated condition. To inflate the balloon 16, the one-way valve 30 is detached from the housing 12 of the bubble blowing device 10. A person then blows air through the bottom of the one-way valve 30. The blowing of the air into the bottom of the one-way valve 30 displaces the valve ball 36 against the bias of the air pressure of the balloon 16 and enables air to flow through the one-way valve 30 and into the balloon 16. When a person stops blowing air into the one-way valve 30, the air pressure in the balloon 16 again advances the valve ball 36 and prevents air from flowing back out the bottom of the one-way valve 30. As such, the one-way valve 30 enables air to be blown into the balloon 16 but prevents air from escaping from the inflated balloon 16.

Once the balloon 16 is inflated, the one-way valve 30 is again attached to the housing 12. Once attached to the housing 12, the one-way valve 30 communicates with an air flow chamber 40. The air flow chamber 40 leads to the output air port 18. Consequently, when the one-way valve 30 is opened, air from the balloon 16 is directed to the output air port 18.

An activation rod 42 extends through the air flow chamber 40. The activation rod 42 is concentrically aligned with the one-way valve 30 and is positioned directly below the one-way valve 30. When the activation rod 42 is biased upwardly, the top of the one-way valve 30 presses against the valve ball 36 within the one-way valve 30. When the upward force from the activation rod 42 surpasses the downward force from the pressure differential in the balloon 16, the valve ball 36 is displaced and air flows from the balloon 16 into the air flow chamber 40.

The activation rod 42 is moved upwardly by the trigger handle 24. The trigger handle 24 is slotted and engages a support rib 46 within the housing 12. The trigger handle 24 is free to move reciprocally along the length of the support rib 46. However, the support rib 46 prevents the trigger handle 24 from moving out of the horizontal plane of the support rib 46.

A pawl 48 extends upward from the rear of the trigger handle 24. The pawl 48 is engaged by a spring 50 that is anchored at one side to the housing 12. The spring 50 provides a bias to the trigger handle 24 that biases the trigger handle 24 into one set position along the support rib 46.

A ramped structure 52 is formed on a segment of the trigger handle 24. When the trigger handle 24 is squeezed in the direction of arrow 54, the trigger handle 24 is moved against the bias of the spring 50 and the ramped structure 52 moves under the bottom of the activation rod 42. The ramped structure 52 acts as a cam and pushes the activation rod 42 upward. As the activation rod 42 moves upward, the activation rod 42 opens the one-way valve 30, in the manner previously described. Accordingly, when the trigger handle 24 is squeezed, the one-way valve 30 is opened and a stream of air passes from the balloon 16 out through the output air port 18.

A gear rack 60 also extends from the trigger handle 24. The gear rack 60 engages a pinion gear 62 that is part of the dipping arm 20. As the trigger handle 24 is squeezed, the gear rack 60 moves horizontally. This causes the pinion gear 62 to turn. As the pinion gear 62 turns, the dipping arm 20 rotates from the first position in the reservoir 23 to the second position in front of the output air port 18. When in the first position, the aperture on the dipping arm 20 is immersed in the reservoir 23. As the dipping arm 20 rotates to the second position, the aperture is lifted out of the reservoir 23 and held in front of the output air port 18. If the aperture supports a soap film, the flow of air out of the output air port 18 creates bubbles.

The amount of bubbles created is dependent upon the volume of soapy water present around the aperture on the dipping arm 20. When there is no more soap film available at the aperture, the trigger handle 24 is released and again squeezed. This action causes the dipping arm 20 to again dip into the reservoir 23 and lift a new volume of soapy water to the output air port 18. The cycle can be repeated as many times as is desired until either the soapy water within the reservoir 23 fall below an effective level or the air from the balloon 16 is exhausted.

It will be understood that the embodiment of the present invention bubble blowing device that is described and illustrated herein is merely exemplary and a person skilled in the art can make many variations to the embodiment shown without departing from the scope of the present invention. For example, the shape, size and appearance of the bubble blowing device can be altered as desired. Furthermore, the position of the balloon and the position of the output port can be repositioned on the bubble blowing device, as desired. All such variations, modifications and alternate embodiments are intended to be included within the scope of the present invention as defined by the appended claims.

What is claimed is:

1. A bubble blowing assembly, comprising:

an air flow chamber having a first end and a second end;

a reservoir for retaining a volume of bubble material;

a one-way valve disposed at said first end of said air flow chamber, wherein said one-way valve is capable of being in an open condition and a closed condition;

an arm that defines an aperture, wherein said arm is selectively positionable between a first position, where said aperture is positioned in said reservoir, and a second position, where said aperture is positioned next to said second end of said air flow chamber;

an activation mechanism that engages both said one-way valve and said arm, wherein said activation mechanism is selectively positionable between an operating position, where said activation mechanism moves both said one-way valve to said open condition and said arm to said second position, and a non-operating position, where said activation mechanism moves both said one-way valve to said closed condition and said arm to said first position.

2. The assembly according to claim 1, further including a source of pressurized air coupled to said first end of said air flow chamber.

3. The assembly according to claim 2, wherein said source of pressurized air is a balloon.

4. The assembly according to claim 1, wherein said one-way valve includes a cylindrical stem around which a balloon can be coupled.

5. The assembly according to claim 1, wherein said air flow chamber and said reservoir are disposed in a common housing and said one-way valve is selectively detachable from said common housing.

6. The assembly according to claim 1, wherein said arm contains a pinion gear thereon and said activation mechanism includes a gear rack that engages said pinion gear and turns said pinion gear as said activation mechanism is moved between said operating position and said non-operating position.

7. The assembly according to claim 1, further including an activation rod that opens said one-way valve when said activation rod is biased against said one-way valve.

8. The assembly according to claim 7, wherein said activation device includes a cam surface that biases said activation rod against said one-way valve when said activation mechanism is moved from said non-operating position to said operating position.

9. The assembly according to claim 1, further including a spring coupled to said activation mechanism for biasing said activation mechanism into said non-operating position.

10. A device for blowing bubbles, comprising:

an inflatable air reservoir having an exit port;

a valve coupled to said exit port for selectively controlling the ability of a stream of air to flow from said inflatable air reservoir through said exit port;

a liquid reservoir;

an arm that defines an aperture, wherein said arm is selectively positionable between a first position, where said aperture is positioned in said liquid reservoir, and a second position, where said aperture is positioned in front of said stream of air; and an activation mechanism for selectively moving said arm into said second position and opening said valve when said arm is in said second position.

11. The device according to claim 10, wherein said inflatable air reservoir is a balloon.

12. The device according to claim 10, wherein said liquid reservoir, said arm and said activation mechanism are contained within a common housing.

13. The device according to claim 12, wherein said valve is selectively attachable and detachable from said common housing.

14. The device according to claim 10, wherein said arm is coupled to said activation mechanism by at least one gear.

* * * * *